United States Patent [19]

McCartny et al.

[11] 4,368,035

[45] Jan. 11, 1983

[54] METHOD AND APPARATUS FOR HEATING AGGREGATE

[76] Inventors: Gerald A. McCartny, 10016 NE. 156th Ave., Vancouver, Wash. 98662; Calvin E. Curtis, 425-½ N.E. 2nd #3, Camas, Wash. 98607

[21] Appl. No.: 259,413

[22] Filed: May 1, 1981

[51] Int. Cl.[3] ..... F27B 14/00; F27B 15/00; F23J 7/00

[52] U.S. Cl. ..... 432/13; 431/4; 431/163; 431/354; 432/14; 432/120

[58] Field of Search ..... 431/4, 163, 354; 432/13, 14, 120

[56] References Cited

U.S. PATENT DOCUMENTS

| | | | |
|---|---|---|---|
| 4,014,637 | 3/1977 | Schena | 431/4 |
| 4,152,374 | 5/1979 | Wenger et al. | 431/354 |
| 4,249,890 | 2/1981 | Graham | 432/13 |
| 4,295,816 | 10/1981 | Robinson | 431/4 |

*Primary Examiner*—John J. Camby
*Attorney, Agent, or Firm*—Kolisch, Hartwell & Dickinson

[57] ABSTRACT

Method and apparatus for heating aggregate in a system which includes a unit for mixing a stream of fuel and a stream of forced air to form a gaseous combustible fuel mixture, and a blower coupled to the unit for supplying it with forced air. The apparatus includes a water-spray device for injecting a fine-particle spray, at an adjustable water-volume rate, into the air-intake opening of the blower. In the method of the invention, the temperature of the heated aggregate is monitored under conditions where the fuel mixture is characterized by a substantially constant fuel-flow rate. The water-volume rate of atomized water spray introduced into the blower is adjusted until a maximum monitored aggregate temperature is observed. The amount of fuel in the moisture-containing fuel mixture is then adjusted to effect heating of the aggregate to a desired temperature.

8 Claims, 2 Drawing Figures

METHOD AND APPARATUS FOR HEATING AGGREGATE

BACKGROUND AND SUMMARY OF THE INVENTION

The present invention relates to an improved method and apparatus for heating aggregate and the like.

In the usual method for producing asphalt, aggregate material is conveyed through a heating chamber where it is heated to a desired temperature before its incorporation into asphalt. Heat is supplied to the heating chamber by a combustible fuel mixture formed in a mixing unit from a stream of fuel and a stream of forced air, and injected from this unit into the chamber. Typically, aggregate-heating systems of this type are automated to the extent that the volume-flow rates of fuel and air introduced into the mixing unit are adjusted automatically to maintain the temperature of heated aggregate being discharged from the chamber substantially constant.

A significant economic factor in asphalt production is the cost of fuel used in operating the aggregate-heating system. Typical heating systems which are widely used in the industry consume the fuel equivalence of about three gallons of liquid fuel per ton of aggregate heated. At the usual aggregate-processing rates, this translates to a fuel consumption rate of several hundred gallons of liquid fuel per hour of operation. It is apparent that a substantial reduction in the fuel consumption rate in such a system would produce considerable cost savings, and environmental benefits as well.

It has been proposed heretofore to increase the efficiency of an aggregate-heating system by humidifying the air introduced into the mixing unit. This has been done, in a system employing a high-volume forced air blower for introducing air into the mixing unit, by placing the intake side of the blower in communication with a large-area water evaporation tank. Water vapor drawn into the blower is introduced thereby into the fuel mixture. Alternatively, it has been proposed to bubble air drawn into such a blower through a water tank, to entrain water vapor in the air stream introduced into the mixing unit. In both methods, the amount of water vapor which can be drawn into the blower is limited by the evaporation rate of water, which, under normal conditions, is insufficient to produce significant fuel efficiency increases in an aggregate-heating system. Further, the volume rates of water drawn into the blower cannot be easily regulated.

One object of the present invention, therefore, is to provide, in an aggregate-heating system, a water-feed apparatus which effects a significant improvement in fuel efficiency in the system.

A related object of the invention is to provide such an apparatus which can be regulated to introduce, into a blower in an aggregate-heating system, a volume rate of water which maximizes fuel efficiency in the system.

Still another object of the invention is to provide such apparatus which is simple to install and operate.

Providing a method of increasing the fuel efficiency in an aggregating-heating system, by introducing a controlled amount of water vapor into the system, is yet another object of the invention.

The water-feed apparatus of the invention includes a water-spray device for producing a fine-particle, or atomized. spray which is injected into the air-flow stream created by the blower in an aggregate-heating system. The spray device is supplied by streams of water and pressurized gas. In a preferred embodiment of the invention, the pressure of gas supplied to the spray is regulatable to adjust the volume-rate of water introduced into the blower. The atomized spray preferably is introduced into the air-intake opening in the blower.

In the method of the invention, an aggregate-heating system is adjusted so that a substantially constant-quantity rate of aggregate is heated by a fuel mixture characterized by a substantially constant fuel-flow rate. While the temperature of the heated aggregate is being monitored, a fine-particle water spray is introduced into the air stream of the blower, and the volume rate of introduced spray is regulated until a maximum monitored aggregate temperature is observed. The amount of fuel supplied to the system is then adjusted to produce a moisture-containing fuel mixture which effects heating of the aggregate to a desired temperature.

These and other objects and features of the present invention will become more fully apparent when the following detailed description of the present invention is read in connection with the accompanying drawings, wherein:

FIG. 1 is a simplified, fragmentary side view of an aggregating-heating system employing apparatus constructed according to the present invention; and FIG. 2 is an enlarged view of portions of the system shown in FIG. 1, as seen generally along line 2—2 therein.

DETAILED DESCRIPTION OF THE INVENTION

Figure 1:
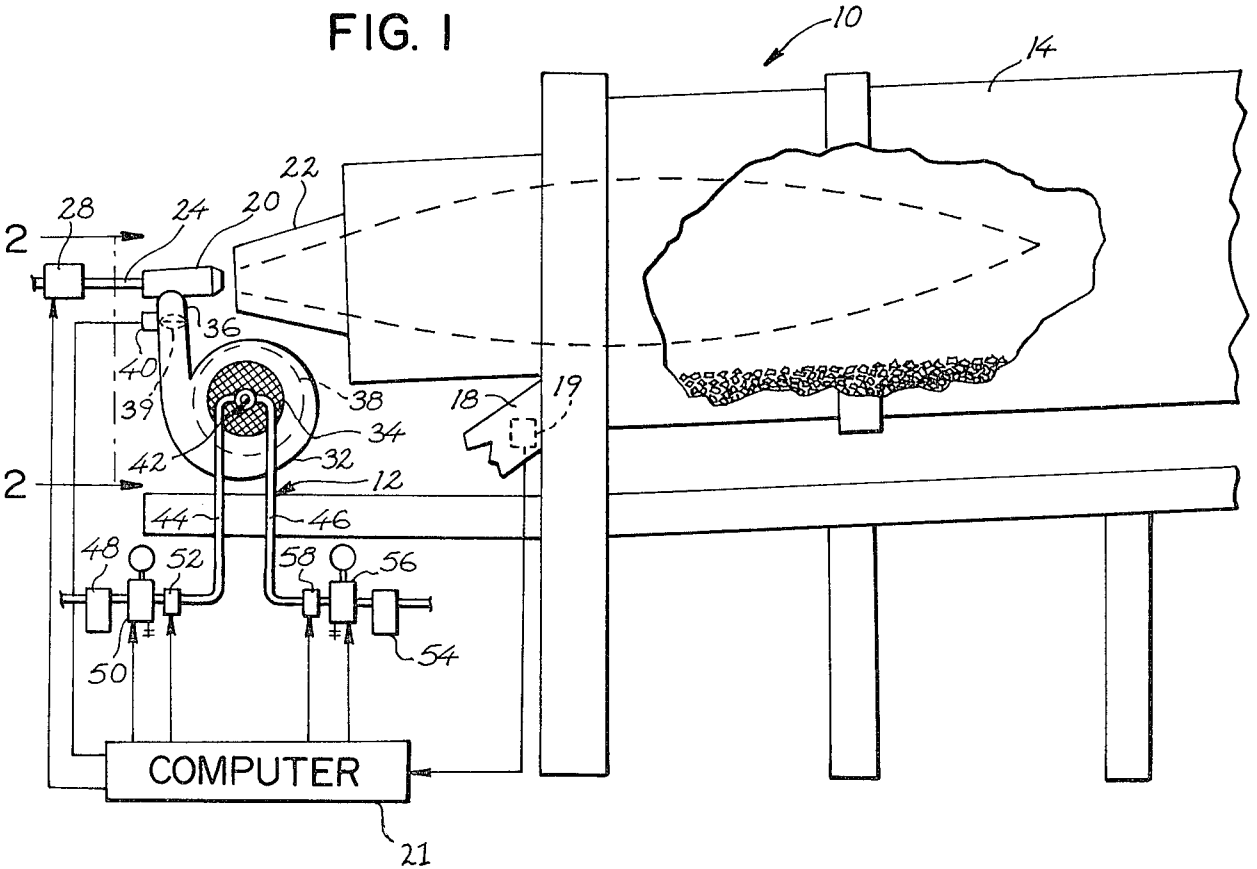

FIG. 1 shows in simplified form an aggregate heating system 10 including a water-feed apparatus 12 constructed according to the present invention. System 10 includes an elongate inclined, rotary heating drum, or chamber, 14 in which aggregate and the like is heated. Such aggregate is shown at 16, and travels along the chamber, from right-to-left in FIG. 1, toward a discharge chute shown fragmentarily at 18. A temperature sensor 19 in the chute is used in monitoring the temperature of aggregate discharged from chamber 14. Sensor 19 inputs control means including a computer 21, whose functioning will be described below.

Aggregate in chamber 14 is heated by a combustible fuel mixture formed in a combustion chamber, or burner box 22 where the fuel mixture is ignited. Chamber 22 is supplied a stream of fuel, which may be either a liquid or a gaseous combustible fuel, from a conventional source (not shown) through a conduit 24 and a unit 20. The rate of fuel supply to unit 20 is controlled by a regulator 28 in the conduit. Regulator 28 is normally under the control of computer 21, but computer control thereof may be overridden, as will be seen. Conduit 24 and regulator 28 are also referred to herein as regulatable fuel delivery means.

Forced air is supplied to unit 20 from a forced-air blower 32. The blower has a circular air-intake opening 34 through which air enters the blower, and a duct 36 from which forced air is supplied to unit 20. A conventional squirrel-cage fan, shown in dashed lines 38 in FIG. 1, creates an air-flow pathway from opening 34 to the upper end of duct 36. The rate of air flow from blower 32 into unit 20 is controlled by a butterfly valve 39 in the upper end of the duct. Valve 39 is selectively positioned in the duct by a motor 40 under the control of computer 21. Air introduced into unit 20 from blower 32 is mixed in the combustion chamber with fuel supplied thereto.

Under normal operating conditions, computer 21 receives temperature input data from sensor 19, and after suitable processing of the signal, outputs appropriate control signals to regulator 28 and motor 40. The control signals set the levels of fuel and air in the mixture which is introduced into chamber 14 to maintain the temperature of aggregate heated in chamber 14 at a substantially constant, preselected temperature. Computer 21, and other components of system 10 described above, with the exception of aparatus 12, are entirely conventional.

Apparatus 12 functions in system 10 to introduce a regulatable volume rate of fine-particle water spray into the forced air supplied to unit 20 from blower 32. The apparatus includes a spray nozzle 42 which is supplied a stream of water and a stream of pressurized gas through fluid supply lines 44, 46, respectively. Water is supplied through line 44 from a conventional pressurized water source (not shown). Arranged in series in line 44 are a water filter 48, a pressure regulator 50 and an on-off solenoid valve 52. Regulator 50 is manually regulatable to produce a desired pressure in line 44, and may also be under the control of computer 21, as shown. The on-off condition of valve 52 is preferably controlled by the computer.

Pressurized gas is supplied to line 46 from a tank of pressurized air (not shown). An air filter 54, a pressure regulator 56 and an on-off solenoid valve 58 are arranged in series line 46, as shown. Valve 58 and regulator 56 are under the control of computer 21, and regulator 56 may be controllable manually as well. The volume-rate of water ejected in spray form from nozzle 42 is generally regulated by adjusting the air pressure supplied to the nozzle, while maintaining the water pressure supplied thereto substantially constant. Specifically, at a particular water-supply pressure, the volume rate of spray is increased by decreasing the air-supply pressure, that is, by increasing the ratio of water pressure/air pressure in nozzle 42.

Figure 2:
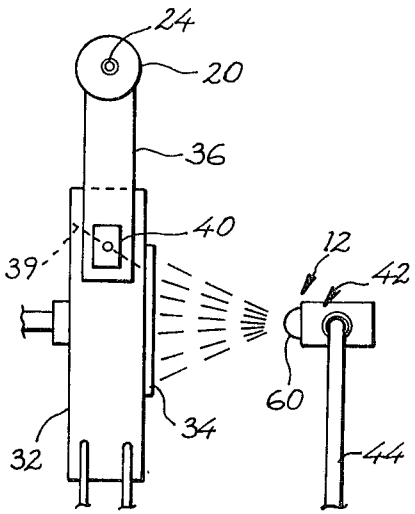

Referring now to FIG. 2, nozzle 42 has a nozzle head 60 in which water and compressed air supplied to the nozzle are mixed and ejected in the form of a fine-particle conical spray. The spray can best be described, in terms of droplet sizes, as a fine mist. In this regard, it is noted that the success of the present invention depends, in part, on the fine-particle nature of the water spray. Explaining further it has been found that introducing, into blower 32, a relatively course-particle water spray—of the type which is produced by pressurized water alone being passed through a spray nozzle—is much less effective in improving fuel efficiency in system 10 than when a fine-particle spray is employed. In the present invention, such spray is produced by the mixing action of compressed air and water in nozzle head 60.

Nozzle 42 is also referred to herein as means for injecting a fine-particle water spray into the air-flow stream of blower 32. Lines 44, 46 are also referred to herein as means for supplying nozzle 42 with a stream of water and a stream of pressurized gas, respectively. Regulators 50, 56 thus function as means for regulating the supply rates of water and pressurized gas streams through the supply means to the nozzle.

In practicing the method of the invention, aggregate is conveyed through chamber 14 at a substantially constant-quantity rate. Regulator 28 and motor 40 are adjusted to produce a fuel mixture which effects heating of the aggregate to a desired temperature, as such is monitored by sensor 19. Computer 21 is placed in an "override" condition wherein the regulator and motor are held in the adjusted conditions just described, independent of the aggregate-temperature changes sensed by sensor 19. That is, the fuel-flow rate in the fuel mixture injected into chamber 14 is held substantially constant.

A fine-particle water spray from nozzle 42 is introduced into the opening of the blower, with the initial water-volume rate of spray being selected arbitrarily, generally at a rate which is lower than that anticipated to produce maximum fuel efficiency in system 10. After a short re-equilibration period, the monitored temperature of the heated aggregate rises above the initially monitored temperature value. The increase in temperature indicates the increased heating capacity of the fuel/air/water mixture compared with a mixture of fuel and air alone. The volume rate of water spray introduced into blower 32 is then adjusted, in the manner noted above, until a maximum aggregate temperature is observed.

Following this adjustment in the volume rate of water spray to achieve a maximum temperature in the aggregate, computer 21 is placed in a condition where it controls regulator 28 and motor 40 to effect aggregate heating to a desired temperature. In the usual situation, where the introduction of water spray into the blower increases the temperature of heated aggregate above the desired temperature, the regulator and motor are now adjusted under the control of computer 21, to reduce the amount of fuel and air supplied to unit 20. The reduction in fuel-supply rate reflects the increased efficiency of the system in heating aggregate to the desired temperature. The extent of fuel savings achievable by the method of the invention can be appreciated from the following specific examples.

In example 1, system 10 was fueled by conventional heating oil. Aggregate was conveyed through chamber 14 at a quantity-rate of about two tons-per-minute. The system was adjusted to produce, under equilibrium conditions, heating of the aggregate to about 350° F., as monitored by sensor 19. Once the desired temperature was reached, the control computer was placed in an "override" condition wherein the levels of fuel and air supplied to unit 20 remained constant. At steady state conditions, fuel consumption of about six gallons-per-minute, or three gallons-per-ton of aggregate, was observed.

Preparatory to introducing water-spray into the system, regulator 50 was adjusted manually to produce a water pressure in line 44 of about 40 psi, and regulator 56 was adjusted to produce air pressure in line 46 of about 60 psi. At these respective pressure settings, and with valves 52, 58 placed in opened conditions, a water spray having a water-supply rate of about 1.4 gallons-per-hour was injected into blower 32. A rise in temperature of the aggregate of several degrees above 350° F. was measured within a few minutes.

The volume rate of water spray was increased in increments of about 0.2 gallons-per-hour each increment being produced by decreasing the air pressure supplied to nozzle 42 by about one-half psi. Following each incremental change in the volume of spray supplied to blower 32, the system was allowed to reach a new steady state at which the aggregate temperature was monitored. This procedure was continued until an optimal volume of water spray of about 2.25 gallons-per-hour producing a maximum heated aggregate temperature of about 375° F., was observed. The optimal water-supply rate was achieved at an air pressure setting of about 48 psi.

With atomized water being supplied to the blower at the above-noted 2.25 gallons-per-hour rate, the computer was then set in its "normal" condition to control the amount of fuel and air supplied to unit 20 to produce heating of the aggregate to 350° F., Specifically, since the system, with the introduction of moisture into the fuel mixture, was now "overheating" the aggregate, both fuel and air supply rates to unit were reduced, under the control of the computer, until a new steady-state condition, resulting in a heating of aggregate to 350° F., was observed. At the latter steady-state condition, fuel consumption was measured at about 4.4 gallons-per-minute, or 2.2 gallons-per-ton of aggregate. These figures are to be compared with the fuel consumption rate of six gallons-per-minute, or three gallons-per-ton, required to heat the aggregate to 350° F. in the absence of water spray in system 10. Introduction of an optimal amount of fine-particle water spray into blower 32, thus results in a net increase in fuel efficiency of about 25%. In a typical aggregate-heating system, this increased efficiency may result in a fuel savings of over 1,000 gallons per day.

Example 2 is substantially like example 1, except that the system was fueled by natural gas rather than a liquid fuel. Here it was observed that, at the aggregate heating rates described above, introduction of an optimal flow rate of atomized water spray into the system reduced the rate of fuel consumption required for heating a given amount of aggregate to 350° F. by about 15%.

While a preferred embodiment of an aggregate-heating system constructed according to the present invention, and a method for practicing the invention have been described herein, it is apparent that various changes and modifications can be made without departing from the spirit of the invention.

It is claimed and desired to secure by Letters Patent:

1. Water-feed apparatus in a system used for heating aggregate and the like, where the system includes a combustion chamber for mixing a stream of fuel and a stream of forced air to form a gaseous combustible fuel mixture, and a blower for supplying the chamber with forced air, said apparatus comprising an atomizing nozzle positioned to inject an atomized water spray producible by the nozzle into the air-flow stream created by the blower, water-supply means connected to said nozzle for suppyling it with a stream of water, and gas-supply means connected to said nozzle for supplying it with a stream of pressurized gas for mixing with said water stream in said nozzle to create such spray.

2. The apparatus of claim 1 which further includes means for regulating the supply rate of at least one of the streams of water and gas through the associated supply means to said injecting means, to produce in the fuel mixture an amount of moisture which minimizes the amount of fuel required to heat a given amount of aggregate to a predetermined temperature.

3. The apparatus of claim 2, wherein said regulating means includes means for increasing and decreasing the pressure of said gas stream to decrease and increase, respectively, the amount of moisture in the fuel mixture.

4. Water-feed apparatus in a system used for heating aggregate and the like, where the system includes a combustion chamber of mixing a stream of fuel and a stream of forced air, regulatable fuel delivery means for supplying the chamber with a regulatable supply of fuel, and a blower for supplying the chamber with forced air, said apparatus comprising an atomizing nozzle positioned to inject an atomized water spray into the air-flow stream created by the blower, for combining with fuel and forced air to produce a combustible fuel mixture, water-supply means connected to said nozzle for supplying it with a stream of water, gas-supply means connected to said nozzle for supplying it with a stream of pressured gas for mixing with said water stream in said nozzle to create such spray, and control means operatively connected both to said delivery means and to at least one of said supply means for controlling the ratio of air/water/fuel in the fuel mixture.

5. The apparatus of claim 4, wherein said control means includes means for regulating the supply rate of at least one of said streams through the associated supply means.

6. The apparatus of claim 5, wherein said regulating means includes means for increasing and decreasing the pressure of said gas stream to decrease and increase, respectively, the amount of water in the fuel mixture.

7. A method for reducing the amount of fuel required to heat a given amount of aggregate and the like to a desired temperature, where the aggregate is heated in a chamber by a gaseous combustible fuel mixture containing such fuel and forced air supplied by a forced-air blower, said method comprising supplying the chamber with a fuel mixture characterized by a substantially constant fuel-flow rate, monitoring the temperature of aggregate heated in such chamber, producing an atomized water spray by mixing pressure-regulated streams of water and pressurized gas, introducing the water spray into the air stream created by the blower, adjusting the supply pressure of at least one of the streams to regulate the volume-rate of water introduced into the blower until a maximum monitored aggregate temperature is observed, and adjusting the amount of fuel in the moisture-containing fuel mixture to effect heating of the aggregate to such desired temperature.

8. The method of claim 7, wherein said supply-pressure adjusting includes increasing and decreasing the pressure of said gas stream to decrease and increase, respectively, the volumerate of water introduced into the blower.

* * * * *